United States Patent [19]

Galloway

[11] 4,441,100

[45] Apr. 3, 1984

[54] ELECTRICAL CIRCUITS

[75] Inventor: John L. Galloway, Edinburgh, Scotland

[73] Assignee: Racal Security Limited, Newbridge, Scotland

[21] Appl. No.: 337,433

[22] Filed: Jan. 6, 1982

[30] Foreign Application Priority Data

Jan. 6, 1981 [GB] United Kingdom ..... 8100217

[51] Int. Cl.[3] ..... G08B 26/00

[52] U.S. Cl. ..... 340/518; 340/514; 340/510; 340/506; 340/537; 340/825.1

[58] Field of Search ..... 340/518, 514, 501, 505–511, 340/531, 536, 537, 515, 825.06, 825.1, 825.34; 179/5 R, 5 P

[56] References Cited

U.S. PATENT DOCUMENTS 3,631,431 10/1971 Cox ..... 340/537
3,646,552 2/1972 Fuhr ..... 340/537

FOREIGN PATENT DOCUMENTS 994428 8/1961 United Kingdom ..... 340/518
1028582 3/1963 United Kingdom ..... 340/518
1487420 12/1974 United Kingdom ..... 340/518

*Primary Examiner*—Donnie L. Crosland
*Attorney, Agent, or Firm*—Leydig, Voit, Osann, Mayer & Holt, Ltd.

[57] ABSTRACT

A security installation has four, for example, normally-closed sensor switches which open in the presence of an intruder. Each switch is in series with a respective resistor and these series combinations are connected in parallel across a pair of bus lines which connect to a central monitoring point. There, normally open test switches are connected across the bus lines in series with respective resistors which have values corresponding to the resistors of the sensor switches. Constant current is applied to the bus lines, and a voltage monitor senses the rise in voltage when one of the sensors opens, and this initiates a scanning unit which closes the test switches in sequence. When the test switch corresponding to the opened sensor is closed, the line voltage reverts to the predetermined value, and the closed test switch identifies the operated sensor.

18 Claims, 5 Drawing Figures

ELECTRICAL CIRCUITS

BACKGROUND OF THE INVENTION

The invention relates to electrical circuit arrangements and more specifically to circuit arrangements for detecting the operation and identity of one of a plurality of switching elements. By way of example, the circuit arrangement to be described may be used in connection with a security installation involving a plurality of sensors each incorporating a respective switching element which is operated when the sensor detects an alarm state, so as to enable the operation and the identity of an operating sensor to be determined.

In security installations used for protecting an area under surveillance from intrusion, it is known to position a number of sensors at different locations in and around the area under surveillance so that the presence of an intruder is indicated at a central monitoring point to which the sensors are connected. In practice, it is desirable to know at the central monitoring point not only that a sensor has operated but also the identity of the sensor (that is, the position within the area under surveillance where the intrusion has taken place). If each sensor is individually wired back to the central monitoring point, then this facility may be achieved, but such an arrangement is complex and time-consuming to install. Circuit arrangements intended to deal with this problem will be described below.

BRIEF SUMMARY OF THE INVENTION

According to the present invention there is provided a circuit arrangement responsive to the operation of one of a plurality of normally inoperated switching elements which each have an inoperated and operated state and for identifying the operated switching element, in which each of the switching elements is connected in combination with a respective first impedance and the combinations are connected in parallel with each other to form a first circuit bank, the first impedances having predetermined and respectively different impedance values so that operation of any one of the switching elements changes the total impedance of the first circuit bank by a respective and predetermined amount, a plurality of testing elements each connected in combination with a respective normally inoperated test switch means having an inoperated and an operated state, these combinations being connected in parallel with each other to form a second circuit bank, monitoring means connected to compare the first and second circuit banks whereby to detect the change in impedance of the first circuit bank from a datum value and resulting from operation of one of the switching elements and responsive thereto to operate the test switch means in a predetermined sequence until the impedance of the first circuit bank is returned to the datum value, the said testing elements being of such nature and having such respective electrical parameters that, when the impedance across the first circuit bank is returned to the said datum value, the identity of the operated one of the switching elements within the plurality of switching elements corresponds to the identity of the operated test switch means within the plurality of test switch means.

DESCRIPTION OF THE DRAWINGS

Electrical circuit arrangements embodying the invention and for monitoring sensors in a security installation will now be described by way of example and with reference to the accompanying diagrammatic drawings in which.

DESCRIPTION OF PREFERRED EMBODIMENTS

Figure 1:
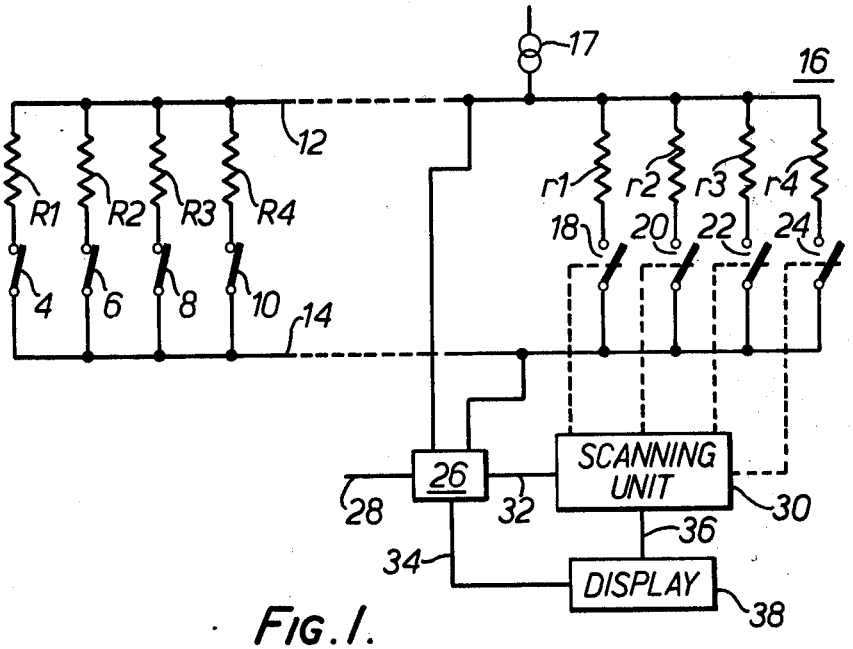
FIG. 1 is a circuit diagram of one of the circuit arrangements.

FIG. 1 shows a circuit arrangement in which there are four sensors, 4, 6, 8 and 10 which are shown as being in the form of respective normally-closed switches. Such sensors could form part of an intruder detection system and would in such a case comprise suitable electrical or electronic switching elements positioned at predetermined points around an area under surveillance and arranged to be operated, that is, switched into an open circuit condition, by the presence of an intruder. Any suitable form of switching element may be used. In a manner to be described the circuit arrangement responds to the open-circuiting of one of the switching elements and identifies which element has operated, thereby not only producing a warning that an intruder is present within the area under surveillance but also indicating where the intrusion has taken place.

As shown, each sensor 4, 6, 8, and 10 is connected in series with a respective resistor R1, R2, R3 and R4 and the resistor-sensor combinations are connected in parallel with each other across a pair of bus lines 12, 14 which connect to the central monitoring point 16.

There may of course be more (or less) than the four sensors illustrated in FIG. 1.

A power supply for the system is provided by means of a constant current generator 17 connected to the line 12.

At the central monitoring point 16, there are provided four normally open test switches 18, 20, 22, 24 corresponding in number to the sensors 4, 6, 8 and 10 and each connected in series with a respective resistor r1, r2, r3, and r4. The test switch-resistor combinations are connected in parallel with each across the lines 12 and 14.

The test switches 18, 20, 22 and 24 may be electronic switches such as transistors.

A voltage comparator 26 is connected between the lines 12 and 14 and compares the voltage across the lines with a reference supplied on a line 28. The comparator controls a scanning unit 30 such that, in a manner more specifically to be described, it causes the test switches 18, 20, 22 and 24 to be closed in sequence when it detects a change in voltage across the lines 12 and 14.

The values of the resistors R1, R2, R3 and R4 are predetermined and different, and the values of the resistors r1, r2, r3 and r4 respectively correspond with them. Thus, for example, the values of the resistors R1, R2, R3 and R4 may be arranged in the ratio $1:\frac{1}{2}:\frac{1}{3}:\frac{1}{4}$ but other arrangements are possible as will be described.

The operation of the arrangement as so far described will now be considered.

Initially, it will be assumed that none of the sensors 4, 6, 8, and 10 is operated and therefore they will all be in the normally closed position. In this situation, the test switches 18, 20, 22 and 24 will all be in their normally open positions and the voltage across the two bus lines 12 and 14 will be at a minimum and below the level of the reference on the line 28.

When one of the sensors 4, 6, 8 or 10 operates (that is, becomes open-circuit in response to presence of an intruder), it disconnects its corresponding resistor from the bus lines. There will therefore be a corresponding increase in voltage across the lines 12 and 14 and this will be detected by the voltage monitoring unit 26 which will produce a corresponding output on line 32. In response to this the scanning unit 30 closes each of the test switches 18, 20, 22 and 24 in turn (opening each such switch before it closes the next one in the sequence) until the voltage across the bus lines is detected by the monitoring unit 26 as once more falling to the predetermind reference. The test switches are closed in such order that the resistors r1, r2, r3 and r4 are connected across the bus lines in descending order of resistance value. Because the resistors r1, r2, r3 and r4 respectively have values equal to those of the resistors R1, R2, R3 and R4, the voltage across the bus lines will fall to the reference value when the identity of the particular one of the test switches 18, 20, 22 and 24 which is closed at that time corresponds with the identity of the particular sensor 4, 6, 8 or 10 which has been operated. Therefore, logic outputs on lines 34 and 36 at this time from the monitoring unit 26 and the scanning unit 30 enable an output unit 38 to display the identity of the operated sensor.

Figure 2:
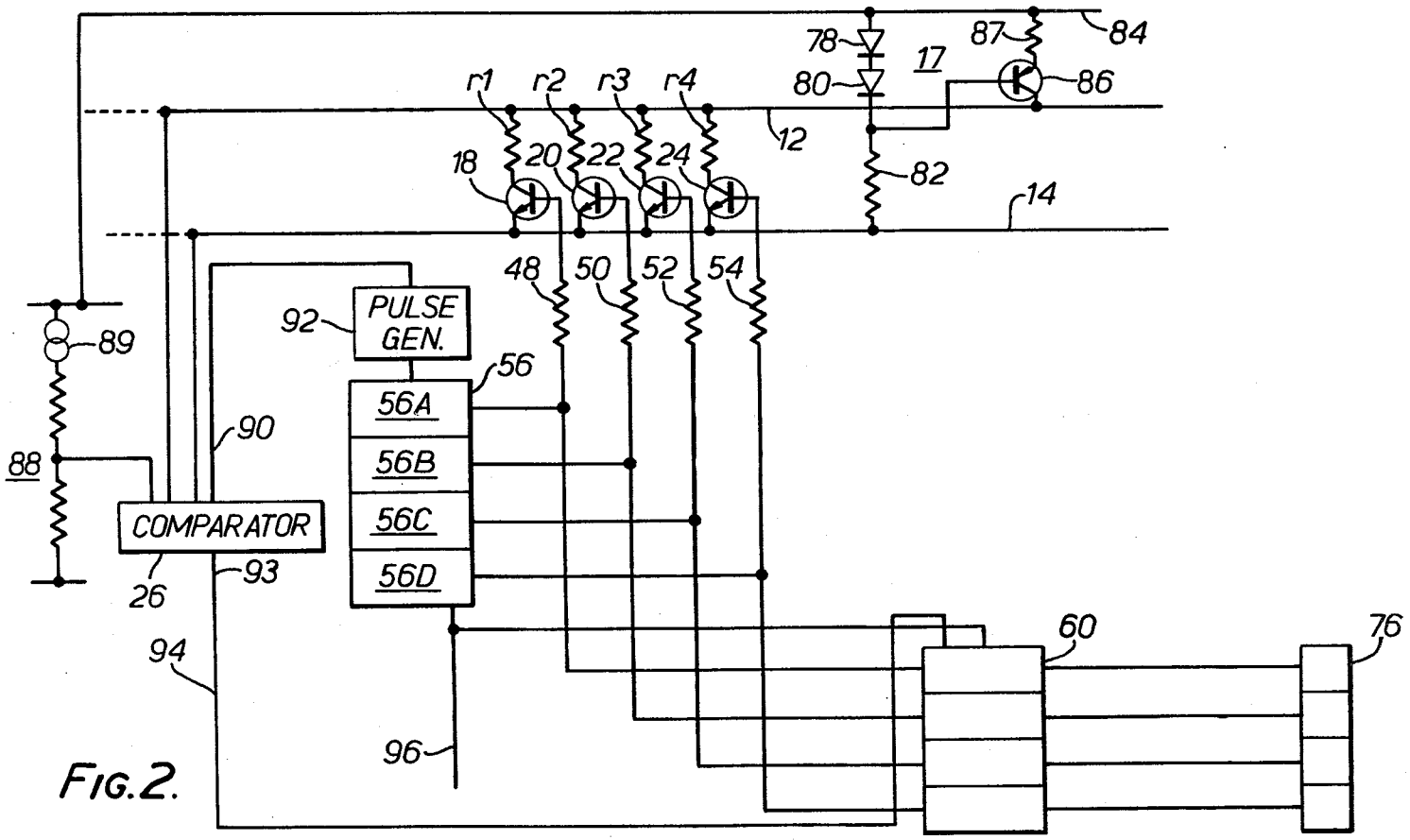
FIG. 2 is a logic diagram showing implementation of the circuit arrangement of FIG. 1.

FIG. 2 shows the circuitry of the monitoring unit 16 in greater detail, and items in FIG. 2 corresponding to those in FIG. 1 are corresponding referenced. FIG. 2 omits the sensors 4, 6, 8 and 10 and the resistor bank R1, R2, R3 and R4.

In FIG. 2 the test switches 18, 20, 22 and 24 are shown as transistors and they have their bases connected through respective resistors 48, 50, 52 and 54 to the respective stage outputs of a four stage shift register 56. Each transistor is rendered conductive when the corresponding shift register stage contains a binary "1".

The binary outputs of the four stages 56A, 56B, 56C and 56D of the shift register 56 are also respectively connected to the four sections of a latch unit 60.

The outputs of the latch unit 60 respectively energise light emitting diodes (LED's) in a bank of LED's 76.

The constant current generator 17 is illustrated in FIG. 2 as comprising two series-connected diodes 78 and 80 connected to line 14 through a resistor 82 from a voltage-regulated supply line 84, and a transistor 86 connected to line 12 through a resistor 87 and having its base connected across resistor 82 so that the conduction of the transistor alters to offset any tendency of the current supplied to the bus lines to change.

The monitoring unit 26 is shown as being supplied with a reference from a potential divider 88 connected between ground and a current source 89 which can be of the same form shown for source 17.

The unit 26 produces an output on a line 90 when it determines that the voltage across the bus lines 12 and 14 has risen above the predetermined level, and this activates a pulse generator unit 92 to cause stepping of the shift register 56 in a manner to be explained. When the monitoring unit 26 determines that the voltage has again fallen to the reference level, it energises an output line 93 which latches the latch unit 60 via a line 94.

When the system is initially activated, the shift register 56 and the latch unit 60 are reset by means of a reset line 96 so that all the stages are reset.

When one of the sensors 4, 6, 8 or 10 (FIG. 1) operates, then, as already explained, the voltage across the bus lines 12 and 14 will rise above the reference level, and the monitoring unit 26 will therefore energise line 90. In response to this, the pulse generator 92 will be set into operation and will place a binary "1" in stage 56A of the shift register 56 so as to render conductive the transistor switch 18 and switch the highest value resistor r1 across the bus lines, and this binary "1" will be stepped through the stages of the shift register, so as to connect the resistors r1, r2, r3 and r4 individually across the bus lines and in that order. As the binary "1" steps through the stages of the shift register 56, it will also be present in the corresponding sections of the latch unit 60. When the transistor switch corresponding to the operated sensor is rendered conductive, the voltage across the bus lines will revert to the reference level, and line 93 will therefore set the latch unit 60 so as to hold the binary "1" in the appropriate section of each of these units.

In a practical sense where an intruder is entering an area under surveillance, he is likely to cause a number of sensors to operate in succession as he passes from one part of the area to the other. Therefore, after the process described above has been carried out, it is likely that another sensor will become operated as the intruder moves on. Therefore, once more the voltage across the bus lines will rise above the reference level and the monitoring unit 26 will produce an output signal on line 90 which will initiate the pulse generator 92 again so as to enter a "1" into stage 56A of register 56 and to step it through the stages of the register again until the particular transistor corresponding to the operated sensor is rendered conductive. When this happens, the monitoring unit 26 will detect the fall in voltage across the bus lines and will produce an output on line 93 which will cause the binary "1" output from the corresponding stage of the register 56 at this time to be latched into the corresponding section of the latch unit 60.

The process described will then repeat again if the intruder operates a third sensor and an appropriate binary "1" will be stored in the corresponding section of the latch unit 60.

Therefore, the system will ensure that latch unit 60 stores a binary "1" in each of the sections corresponding to the sensors which have been operated. These binary "1" outputs will energise the appropriate LED's in the bank 76. In this way, the display indicates the identity of all the sensors which have operated.

The system can then be reset by means of the line 96 and is ready for detection of a further intruder.

Many modifications are possible to the circuit arrangement.

For example, instead of connecting a bank of test switch-resistor combinations in parallel across the bus lines (that is, the switches 18 to 24 and the resistors r1 to r4), and connecting each one, in turn, across the bus lines in response to operation of a sensor, so as to detect which switched-in test resistor corresponds with the resistor switched out of circuit by the operated sensor, it is possible to provide a bank of current sources connected in parallel across the bus lines through normally closed test switches. The currents produced by the current sources would be graded in inverse ratio to the values of the resistors R1 to R4 in series with the sensors. When a sensor is operated, so as to switch its corresponding resistor out of circuit, the voltage across the bus lines would rise and this would be detected by the voltage monitoring unit which, using logic circuitry of the same general form as described above with reference to FIG. 2, would switch the current sources out of circuit in turn (starting with the current source producing the lowest current), each source being reconnected before the next one is switched out of circuit, until the voltage monitoring unit detects that the voltage across the bus lines has been brought back to the reference level. This will indicate that the current source switched out of circuit corresponds to the resistor controlled by the operated sensor, and thus identifies the operated sensor.

With the arrangements so far described (whether using resistors in series with the test switches or current sources in series with them), it is only possible to detect a single operated sensor at any time. In other words, the system operates by substituting one only of the test resistors (or one only of the current sources) at a time, until the test resistor corresponding to the resistor switched out of circuit by the operated sensor has been identified. If more than one sensor is operated at the same time, then the circuit arrangements so far described will not normally be able to identify either one of these sensors.

In a modified form of the circuit arrangement, however, this problem is overcome. In the modified arrangement, the values of the resistors R1, R2, R3 and R4 are related to each other in the ratio 1:2:4:8, that is, according to a binary weighting system. The resistors r1, r2, r3 and r4 have corresponding values.

The system operates generally in the manner already described with reference to FIG. 1 in that the voltage monitoring unit 26 detects operation of a particular one of the sensors 4, 6, 8, 10 and 12 by responding to the resultant increase in voltage above the reference level and then activates the scanning unit 30 so as to switch the test resistors r1, r2, r3 and r4 into circuit until the voltage monitor 26 detects that the voltage across the bus lines has been brought back to the reference value. However, in the modified arrangement the test resistors are connected to the bus lines in sequence until the voltage across the line is equal to the reference. Because of the binary weighting of the resistor values, it follows that, if more than the sensor is in the operated condition at the same time, then when the voltage monitor 26 determines that the voltage across the bus lines has been brought back to the reference level, the operated sensors will be identified by the identities of the particular ones of the test switches 20, 21, 22 and 24 which are closed at that time. In other words, each possible combination of operated sensors corresponds to a unique combination of closed test switches. With this arrangement, each test resistor is not necessarily disconnected from the bus lines before the next one is connected.

Figure 3:
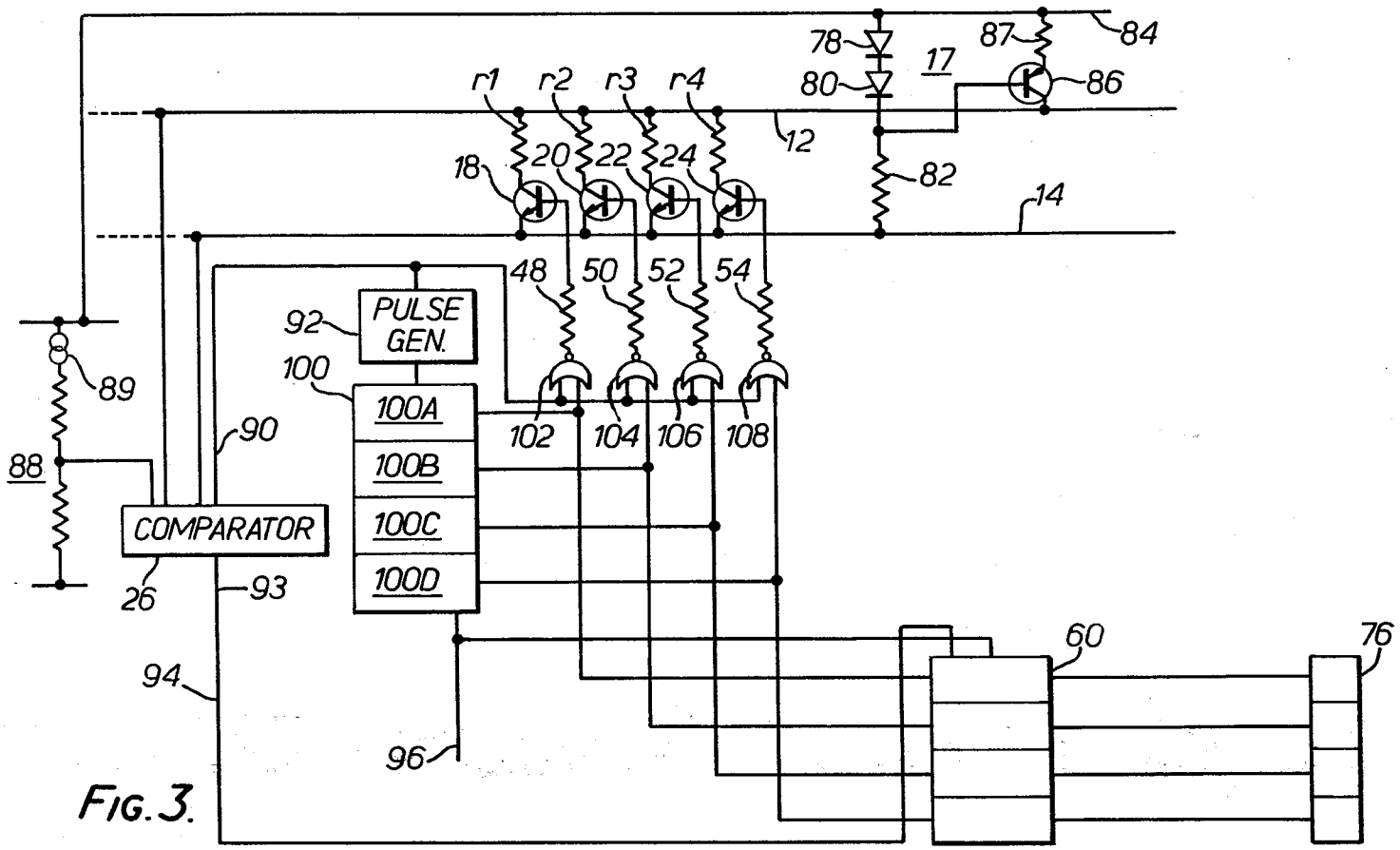
FIG. 3 is a logic diagram showing implementation of a modified form of the circuit arrangement of FIG. 1.

FIG. 3 shows circuitry for implementing such a modified arrangement in which the resistance values of the resistors R1, R2, R3 and R4 are related as 1:2:4:8 and the resistors r1, r2, r3 and r4 have corresponding values. FIG. 3 is similar in many respects to FIG. 2 and items in FIG. 3 corresponding to FIG. 2 are similarly referenced.

FIG. 3 differs from FIG. 2 in that the shift register 56 of FIG. 2 is replaced by a binary counter 100 having four stages 100A, 100B, 100C and 100D. Each stage output is connected to the appropriate one of the transistors 18, 20, 22 and 24 through a respective NOR gate 102, 104, 106, 108. The other inputs of the NOR gates are fed in common from the output of the comparator 26 on line 90.

The operation of the circuit of FIG. 3 will now be described.

When the system is initially activated, the counter 56 and the latch unit 60 are reset by means of the reset line 96. Each counter stage 100A, 100B, 100C and 100D will therefore be producing a "1" output, and a "1" will exist on line 90. Therefore, all the transistors 18, 20, 22, 24 will be off.

When one or more of the sensors 4, 6, 8 or 10 (FIG. 1) operates, the voltage across the bus lines 12 and 14 will rise above the reference level, and the monitoring unit 26 will therefore energise line 90 with a binary "0". This sets the pulse generator 92 into operation to commence counting the counter 100 and also feeds a "0" to all the NOR gates 102, 104, 106 and 108 so as to render conductive all the transistor switches 18 to 24 and therefore connect all the resistors r1, r2, r3 and r4 across the bus lines. Assuming that not all the sensors 4, 6, 8, 10 have operated, this will over-compensate for the loss of resistance across the bus lines. As the counter 100 begins to count, however, a binary representation of its count will appear on the output lines of its stage and this will cause the NOR gates to switch off the transistors 18 to 24 in such sequence as to increase the total resistance across the bus lines stepwise towards the maximum. When the resistance applied across the bus lines by the conducting one or ones of the transistors 18 to 24 exactly compensates for the loss of resistance caused by the operated one or ones of the sensors 4 to 10, the voltage across the bus lines will revert to the reference level, and line 93 will therefore set the latch unit 60 so as to hold a binary "1" in the appropriate section or sections of the unit.

As before, if the intruder then causes a further sensor or sensors to operate as he passes from one part of the area to the other, the process described above repeats. As before, therefore, a "1" will be latched into the corresponding section (or sections) of the latch unit 60.

Figure 4:
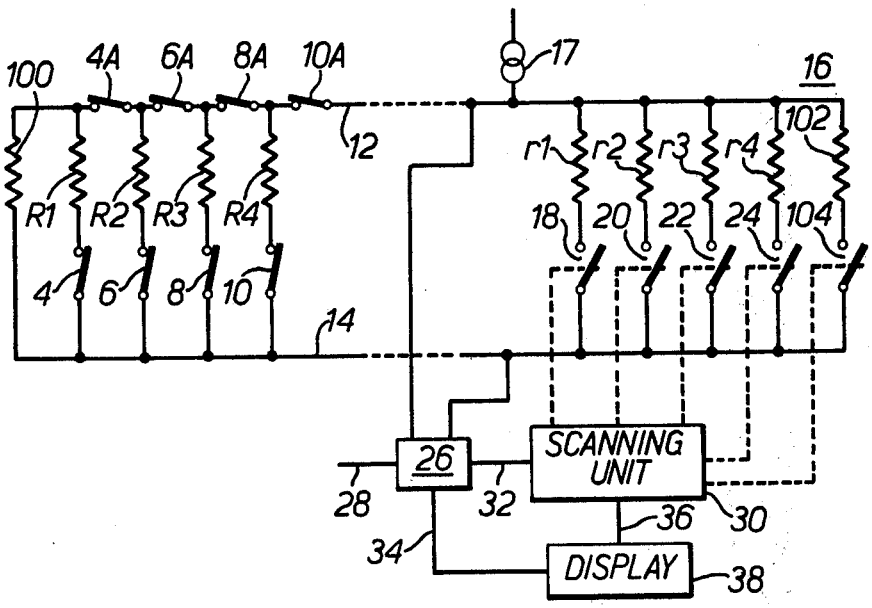
FIG. 4 is a circuit diagram of another modified form of the circuit arrangement of FIG. 1.

FIG. 4 shows an arrangement of the modified type described above, in which the resistors R1 to R4, and the resistors r1 to r4 have their values arranged according to a binary sequence. In addition, a respective "tamper switch" is associated with each sensor and is arranged to be normally closed but to be opened by any attempt at unauthorised interference with the sensor. For example, each tamper switch might be in the form of a microswitch held normally closed by a cover on the sensor so as to be rendered open-circuit by removal of the cover. As shown, the tamper switches 4A, 6A, 8A, 10A respectively corresponding to the sensors 4, 6, 8 and 10 are connected in series in the bus line 12. In addition, an extra resistor 100 is connected across the bus lines having a value less than any of the resistors R1 to R4. A corresponding resistor 102 is connected across the bus lines at the central monitoring station 16, in series with an additional test switch 104.

In response to operation of any one or more of the sensors 4, 6, 8 and 10 the circuit arrangement responds in the manner already described.

However, when any of the tamper switches 4A, 6A, 8A and 10A is open-circuited, this not only has the effect of disconnecting all the resistors in series with the sensors downstream of the open-circuited tamper switch but additionally disconnects the resistor 100. Therefore, in order to bring the circuit arrangement back into balance, with the voltage across the bus lines equal to the reference voltage, it is necessary not only for the appropriate ones of the test switches 18, 20, 22 and 24 to be closed but also for switch 104 to be closed to bring resistor 102 into circuit as well. Therefore, the arrangement is able to distinguish the operation of a tamper switch from the operation of one or more sensors and to identify the particular tamper switch which has been operated.

In the circuit arrangements described above, it was assumed that the sensors 4, 6, 8, 10 are in the form of normally closed switches while the test switches 18, 20, 22 and 24 are in the form of normally open switches. However, it will be appreciated that the circuit arrangements can be constructed to operate in the reverse situation, that is, with the sensors 4, 6, 8 and 10 normally open and the test switches 18, 20, 22 and 24 normally closed.

It is also possible to implement the circuit arrangements described by arranging them in the form of bridge-type circuits.

Figure 5:
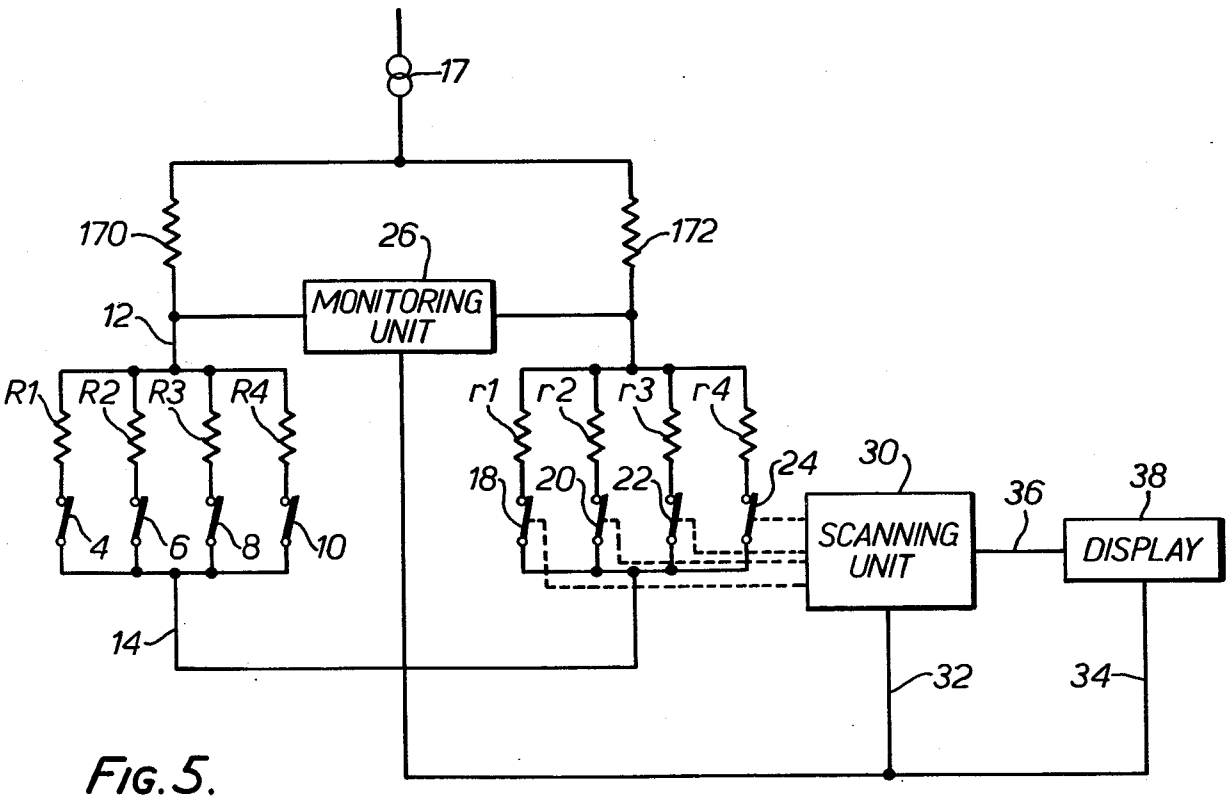
FIG. 5 shows how the circuit arrangement of FIG. 1 may be implemented as a bridge circuit.

Thus, for example, FIG. 5 shows the circuit arrangement of FIG. 1 but rearranged in the form of a bridge-type circuit in which items corresponding to those in FIG. 1 are similarly referenced.

As shown, the sensors 4, 6, 8 and 10 and their associated resistors R1, R2, R3 and R4 form a bank connected in one arm of the bridge via the bus lines 12 and 14, while the test switches 18, 20, 22 and 24 and their associated resistors r1, r2, r3 and r4 form a corresponding bank connected in the opposite arm of the bridge. The other two arms of the bridge are formed by fixed resistors 170 and 172 and the bridge is fed with a constant current from a constant current generator circuit 17.

In this case, unlike the arrangement in FIG. 1, the test switches 18, 20, 22 and 24 are normally closed.

The voltage monitoring circuit 26 is connected across the bridge circuit.

In operation, with none of the sensors operated, the bridge will be in balance. When one of the sensors operates, the bridge will be thrown out of balance and this will be detected by the voltage monitoring circuit 26 which will operate the scanning unit 30 so as to open the test switches 18, 20, 22 and 24 in turn (re-closing each switch before opening the next one), starting with the switch in series with the highest value resistor, until the bridge once more comes into balance. The identity of the open test switch at this time therefore corresponds with the identity of the operated sensor.

It is believed clear that the other forms of circuit arrangement described above can also be implemented in a bridge-type circuit.

What is claimed is:

1. A circuit arrangement responsive to the operation of one of a plurality of normally inoperated switching elements which each have an inoperated and operated state and for identifying the operated switching element, comprising a plurality of first impedances, means connecting each of the switching elements in combination with a respective one of the first impedances, means connecting the combinations in parallel with each other to form a first circuit bank, the first impedances having predetermined and respectively different impedance values so that operation of any one of the switching elements changes the total impedance of the first circuit bank by a respective and predetermined amount, a plurality of testing elements, a plurality of normally inoperated test switch means each having an inoperated and an operated state, means connecting each testing element in combination with a respective one of the first switch means, these combinations being connected in parallel with each other to form a second circuit bank, monitoring means connected to compare the first and second circuit banks whereby to detect the change in impedance of the first circuit bank from a datum value and resulting from operation of one of the switching elements and responsive thereto to operate the test switch means in a predetermined sequence until the impedance of the first circuit bank is returned to the datum value, the said testing elements being of such nature and having such respective electrical parameters that, when the impedance across the first circuit bank is returned to the said datum value, the identity of the operated one of the switching elements within the plurality of switching elements corresponds to the identity of the operated test switch means within the plurality of test switch means.

2. A circuit arrangement according to claim 1, in which the first and second circuit banks are interconnected by two lines, including means for supplying a substantially constant current to the said lines.

3. A circuit arrangement according to claim 2, in which the monitoring means comprises means for comparing the voltage across the lines with a predetermined reference value.

4. A circuit arrangement according to claim 2, in which the testing elements of the second circuit bank are respective impedances and their said electrical parameters are their respective impedance values which correspond respectively with those of the first circuit bank.

5. A circuit arrangement according to claim 1, in which the first and second circuit banks are interconnected by two lines and the monitoring means comprises means for comparing the voltage across the lines with a predetermined value, and the testing elements of the second circuit bank are respective constant current sources and their said electrical parameters are their respective current values which are related to each other in the same proportions as are the impedance values of the said first impedances.

6. A circuit arrangement according to claim 1, in which the first and second circuit banks are connected in two arms of a four arm bridge circuit and the monitoring means comprises means for detecting when the balance of the bridge changes by operation of one of the switching elements of the first circuit bank.

7. A circuit arrangement according to claim 6, in which the testing elements of the second circuit bank are respective impedances and their said electrical parameters are their respective impedance values which correspond respectively with those of the first circuit bank.

8. A circuit arrangement according to claim 7, in which the testing elements of the second circuit bank are respective constant current sources and their said electrical parameters are their respective current values which are related to each other in the same proportions as are the impedance values of the said first impedances.

9. A circuit arrangement according to claim 1, in which the impedances of the first circuit bank are such that their impedance values are related to each other in simple ratio to each other.

10. A circuit arrangement according to claim 9, in which the ratio is $1:\frac{1}{2}:\frac{1}{3}:\frac{1}{4}$ . . . .

11. A circuit arrangement according to claim 1, in which the impedances of the first circuit bank are related to each other according to a binary relationship.

12. A circuit arrangement for detecting operation of any one of a plurality of normally inoperated sensors which each have a respective switch assuming a closed state when the sensor is inoperated and an open state when the sensor is operated, and for identifying the operated sensor, comprising:

a plurality of first resistors each connected in series with a respective one of the sensors, the resistors having respective predetermined reference values;

means connecting the sensor-resistor combinations in parallel with each other and connecting the parallel combination across a pair of lines;

a plurality of normally open test switches each connected in series with a respective test resistor, the test resistors having respective predetermined resistance values corresponding with those of the first resistors;

means connecting the test switch-test resistor combinations in parallel with each other across the said lines;

means for supplying a substantially constant current to the said lines;

monitoring means connected to sense the voltage across the said lines and to compare it with a predetermined value whereby to be rendered operative by detection of the change in voltage resulting from operation of one of the sensors; and scanning means responsive to operation of the monitoring means to close the test switches in a predetermined sequence until the voltage across the lines is brought back to the predetermined value whereby the operated one of the sensors will be identified by the closed one of the test switches.

13. A circuit arrangement according to claim 12, in which the first resistors have their resistance values related to each other in simple ratio to each other.

14. A circuit arrangement according to claim 13, in which the ratio is $1:\frac{1}{2}:\frac{1}{3}:\frac{1}{4}$ . . . .

15. A circuit arrangement according to claim 13, in which the scanning means is arranged so that the predetermined sequence first closes the test switch in series with the highest value test resistor and then closes the test switch in series with the next value test resistor and so on for the remaining test switches, with each closed test switch being opened when the next one in the sequence is closed.

16. A circuit arrangement according to claim 12, in which the first resistors have their resistance values related to each other in the manner of a binary relationship.

17. A circuit arrangement according to claim 16, in which the scanning means is arranged so that the predetermined sequence is a binary sequence corresponding with the binary relationship of the test resistors.

18. A circuit arrangement according to claim 17, comprising a plurality of normally closed auxiliary switches, each associated with a respective one of the sensors, one of the sensor-first resistor combinations being connected across the said pair of lines only through the auxiliary switch associated with its sensor, the next sensor-first resistor combination being connected across the said pair of lines through the auxiliary switch associated with its sensor and through the auxiliary switch associated with the sensor of the said one sensor-first resistor combination, and so on for the remaining sensor-first resistor combinations;

an auxiliary resistor connected across the said pair of lines through all the auxiliary switches in series;

an additional test switch;

a corresponding auxiliary resistor connected across all the test switch-test resistor combinations through the additional test switch, whereby the monitoring means is rendered operative by detection of the change in voltage resulting from opening of one of the auxiliary switches; and means connecting the scanning means to include closure of the said additional test switch in the said predetermined sequence whereby the voltage across the said lines is brought back to the predetermined value when the or each test switch is closed which corresponds to the or each sensor which has been disconnected from across the lines by the opened auxiliary switch and when the additional switch is closed, thereby enabling identification of the opened auxiliary switch.

* * * * *